US008739506B2

(12) United States Patent
Bolzt et al.

(10) Patent No.: US 8,739,506 B2
(45) Date of Patent: Jun. 3, 2014

(54) WATCH BRACELET WITH CERAMIC LINKS

(75) Inventors: Sébastien Bolzt, Bienne (CH); Sylvain Boucard, Villers-le-Lac (FR); Christian Verdon, Boussens (CH); Alain Geiser, Murten (CH)

(73) Assignees: Montres Rado SA, Lengnau (CH); Comadur S.A., Le Locle (CH)

( * ) Notice: Subject to any disclaimer, the term of this patent is extended or adjusted under 35 U.S.C. 154(b) by 168 days.

(21) Appl. No.: 13/364,959

(22) Filed: Feb. 2, 2012

(65) Prior Publication Data

US 2012/0198885 A1 Aug. 9, 2012

(30) Foreign Application Priority Data

Feb. 3, 2011 (EP) ..... 11153173

(51) Int. Cl.
*A44C 5/10* (2006.01)
*F16G 15/04* (2006.01)

(52) U.S. Cl.
CPC ..... *A44C 5/107* (2013.01)
USPC ..... 59/78; 59/80; 59/82; 59/84; 59/93; 63/3; 63/4

(58) Field of Classification Search
USPC ..... 59/78, 80, 82, 84, 93; 63/3, 4
See application file for complete search history.

(56) References Cited

U.S. PATENT DOCUMENTS

| | | | | |
|---|---|---|---|---|
| 6,564,540 | B2 | 5/2003 | Greguitch et al. | |
| 6,622,469 | B2 | 9/2003 | Günster et al. | |
| 7,146,793 | B1 * | 12/2006 | Hyun | 59/80 |
| 7,594,385 | B2 | 9/2009 | Kriknoff | |
| 7,730,710 | B2 | 6/2010 | Rejzner | |

FOREIGN PATENT DOCUMENTS

| | | | |
|---|---|---|---|
| CH | 695 389 | A5 | 4/2006 |
| CH | 699 811 | B1 | 5/2010 |
| EP | 1 136 012 | A1 | 9/2001 |
| EP | 1 214 898 | A1 | 6/2002 |
| EP | 1 428 451 | A1 | 6/2004 |
| EP | 1 173 074 | B1 | 5/2005 |
| EP | 2 057 914 | A1 | 5/2009 |
| EP | 2 260 740 | A1 | 12/2010 |
| FR | 2 918 852 | A1 | 1/2009 |
| WO | 2009/020186 | A1 | 2/2009 |

* cited by examiner

*Primary Examiner* — David B Jones
(74) *Attorney, Agent, or Firm* — Sughrue Mion, PLLC

(57) ABSTRACT

Housing insert for a spacer of a ceramic link for a bracelet, including a housing for receiving a spacer having one end. It includes an external machined portion arranged to cooperate with this housing and an internal machined portion including a substantially cylindrical bearing area, arranged to closely receive this end and having a smaller diameter than that of this end. An equipped link includes such a link and such an insert of this type fixed in this housing. A bracelet including includes a plurality of equipped lateral links into which removably mounted spacers are driven. This bracelet includes intermediate links assembled to pivot freely relative to these spacers or relative to pins pivotably mounted in these equipped links.

31 Claims, 4 Drawing Sheets

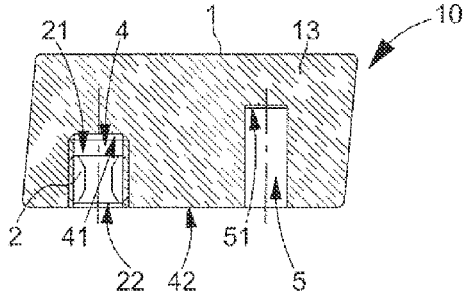
Fig. 4
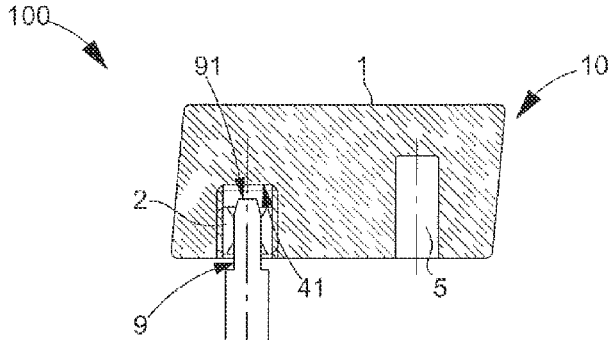
Fig. 5
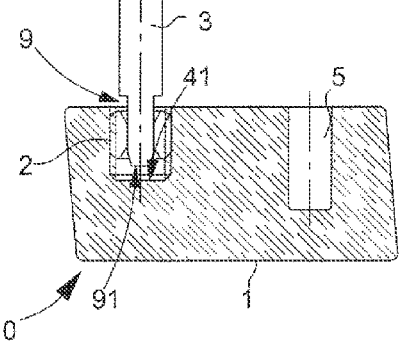
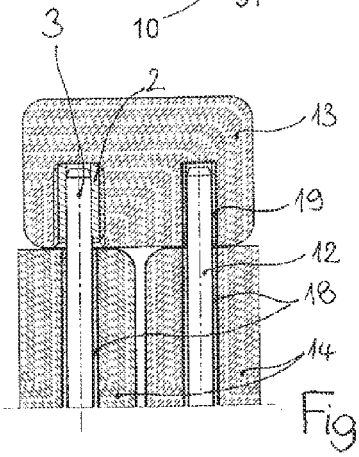
Fig. 6
Fig. 10
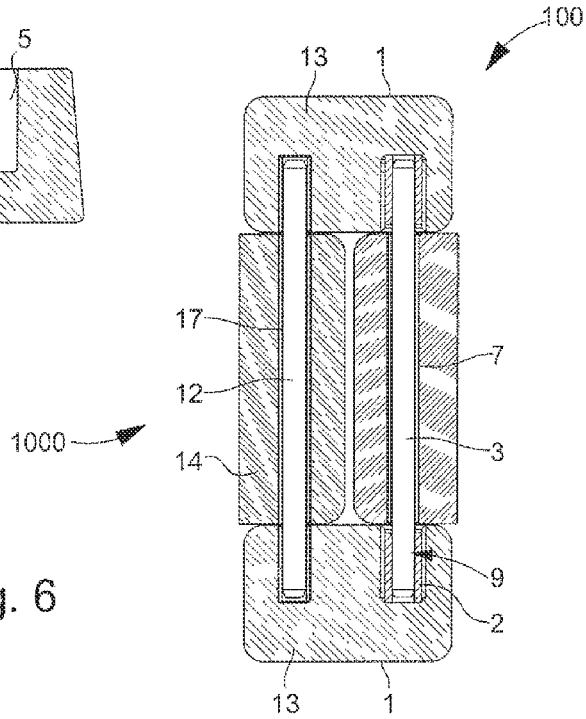

WATCH BRACELET WITH CERAMIC LINKS

This application claims priority from European Patent Application No. 11153173.7 filed Feb. 3, 2011, the entire disclosure of which is incorporated herein by reference.

FIELD OF THE INVENTION

The invention concerns a housing insert for a spacer piece of a ceramic link for a bracelet or piece of jewellery or timepiece, said link being of the type including at least a first housing for receiving a spacer piece or a pin having at least one end.

The invention further concerns an equipped link including at least one ceramic link for a bracelet or piece of jewellery or timepiece, said link including at least a first housing for receiving a spacer piece or a pin.

The invention further concerns an assembled link including, on both sides of a median plane, at least two such equipped links and including at least one spacer piece having two ends arranged to cooperate, at said two ends, with two of said equipped links.

The invention further concerns a bracelet including a plurality of links including at least one such equipped link.

The invention concerns the field of watch-jewellery and jewellery and in particular the field of bracelets with multiple links, which may or may not be articulated.

BACKGROUND OF THE INVENTION

The problem to be overcome is that of fixing connection and/or articulation spacer pieces in ceramic links, and in particular in a blind arrangement.

In order to make a bracelet, particularly a watch bracelet, with ceramic links, with invisible coupling, spacer and/or articulation means must be set in place, in the latter case to guide pivoting, resting on one surface of certain links, which is turned towards a median plane of the bracelet.

These pivoting guiding means are made in a known and economical manner in the form of spacer pieces or pins.

It is not possible to drive spacer pieces or pins into ceramic material without causing damage, and the usual technique consists in directly mounting each spacer piece or pin in a blind bore or pierced hole, by bonding or by an irreversible method such as welding, with the drawback of limited resistance in the first case, or the impossibility of removal in the second case. Any stress applied by the user, for example when the bracelet is twisted, is passed on to the ceramic material by the spacer piece or pin, and the ceramic material may consequently be damaged, not only during assembly, but also during use.

Various documents are known concerning the invisible assembly of watch bracelets with articulated links, with pins mounted blind in lateral links:

- Patek Philippe Patent No. EP 1 136 012, which is specific to a lightened bracelet, discloses central links with a tubular metal casing, which houses at least one plastic insert provided with two passages, each receiving a pin or screw in a friction tight fit. The technical problem overcome is the removal of wear and soiling of the links, by reducing friction. The assembly of the pins in lateral links is not characteristic.
- Chatelain SA Patent No. FR 2 918 852 B1 claims a transparent weld of pins in their blind recesses in lateral links, by electron beam bombardment. This assembly of the pins is irreversible, and impossible to dismantle.

- Tag Heuer Patent No. EP 1 173 074 discloses a bracelet where the links are assembled by pins, to which access can only be obtained by removing a link from the row following the pin concerned, in a strict order of assembly. The assembly of pins in the lateral links is not characteristic.
- Rolex Patent No. EP 1 428 451 B1 discloses pins driven directly onto the lateral links, which is simply not possible with ceramic material.
- Rolex Patent No. EP 2 057 914 discloses a bracelet with bearings assembled at the end of the pins, these bearings are not inserted in the lateral links, but in the intermediate links. This Patent claims the forming of articulations, with friction surfaces selected in a particular manner: all of the friction surfaces of each articulation are formed by a pair of materials consisting of a first material of greater hardness than 800 HV and a second material selected from a list, which includes in particular ceramic material and nickel free stainless steel. The assembly of the pins in lateral links is not characteristic.

SUMMARY OF THE INVENTION

The invention proposes to overcome the problems of the prior art, and to provide a solution for assembling metal spacer pieces in bracelet links made of ceramic or other similar materials.

The invention favours a force fit, by driving the spacer piece into an insert type intermediate component, which is adjustably assembled, and may easily be pre-assembled, in each link concerned.

Thus, it remains possible to dismantle the spacer piece relative to the sub-assembly formed of a link and its insert.

Preferably, this insert is assembled in an irreversible manner in the link.

Thus, the invention concerns a housing insert for a spacer piece of a ceramic link for a bracelet, or piece of jewellery or timepiece, said link being of the type including at least a first housing for receiving a spacer piece or a pin having at least one end, characterized in that said insert includes an external machined portion arranged to cooperate with said first housing, and an internal machined portion including at least one substantially cylindrical bearing area, arranged to closely receive one said end of one said spacer piece, and having a smaller diameter than that of said end.

According to a feature of the invention, said external machined portion has a threaded profile or a non-cylindrical profile.

The invention further concerns an equipped link including at least one ceramic link for a bracelet, or piece of jewellery or timepiece, said link including at least a first housing for receiving a spacer piece or a pin, characterized in that said equipped link includes at least one insert fixed in one said at least one first housing.

According to a feature of the invention, in addition to a said first housing occupied by a said insert, the link includes at least a second housing arranged for receiving another spacer piece or pin.

According to a feature of the invention, said first housing has a threaded profile or a non-cylindrical profile.

According to yet another feature of the invention, said insert is fixed in an irreversible manner in said first housing.

The invention also concerns an assembled link including, on both sides of a median plane, at least two equipped links, and including at least one spacer piece including two ends arranged to cooperate, at said two ends, with two said equipped links, characterized in that, on both sides of said median plane, said spacer piece is driven at each of said two ends, into a said insert comprised in each of said two equipped links joined by said spacer piece.

The invention further concerns a bracelet including a plurality of links including at least one equipped link, characterized in that said equipped link is a lateral link into which a removably mounted spacer piece is driven.

According to a feature of the invention, the bracelet includes at least one intermediate link assembled to pivot freely relative to a spacer piece driven into said equipped link or said assembled link or relative to a pin pivotably mounted in said equipped link or said assembled link.

According to another feature of the invention, said intermediate link includes a first guide arranged to directly or indirectly guide the pivoting of a said spacer piece, and a second guide arranged to directly or indirectly guide the pivoting of a said pin.

BRIEF DESCRIPTION OF THE DRAWINGS

Other features and advantages of the invention will appear more clearly upon reading the following detailed description, with reference to the annexed drawings, in which:

FIG. 4 shows, in a similar manner to FIG. 3, an equipped link which results from combining the bare link of FIG. 3 with an insert according to the invention.

FIG. 5 shows a schematic longitudinal cross-section of an assembled bracelet link resulting from the assembly of a spacer piece on the equipped link of FIG. 4, shown with an equipped link of this type on each side of the spacer piece.

FIG. 6 shows a schematic, partial view of a bracelet comprising a series of assembled links according to the invention in a cross-section passing through the spacer piece.

FIG. 10 shows a schematic, partial view similar to FIG. 6 of a variant of the invention including smooth tubes for limiting the wear of the links.

DETAILED DESCRIPTION OF PREFERRED EMBODIMENTS

The invention concerns the field of watch-jewellery and jewellery and in particular the field of bracelets with multiple links, which may or may not be articulated.

The invention concerns the manufacture of bracelets comprising ceramic links, these links being joined, preferably in an articulated manner, by invisible spacer pieces housed in blind machined holes in lateral links comprised in said bracelets.

It is clear that, for the purposes of the invention, the generic term "ceramic" also means various other fragile materials that can be used for making bracelet links, for example, glass, crystal, enamels, certain gems or suchlike, or even hard metal or carbide or suchlike, or yet more generally any materials which chip or crack when a shock or too high local pressure is applied.

To make such manufacture possible without damaging the ceramic material of the links, the invention consists in placing inserts in these ceramic bracelet links, to allow a spacer piece to be driven therein without damaging the ceramic material.

The invention consists in fixing, particularly by screwing in/bonding, inserts made of hard material, for example steel, into ceramic links. It is then possible to drive steel pins into these inserts without damaging the ceramic material.

Blind assembly is also possible, so that no holes are visible from the exterior of the bracelet, for an embodiment with several rows of links.

Figure 1:
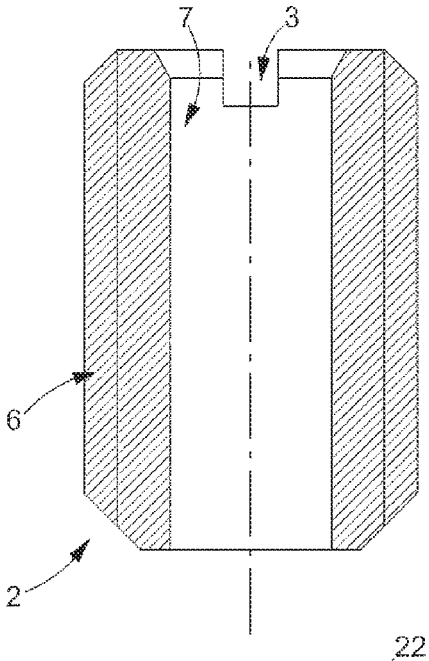
FIG. 1 shows a schematic longitudinal cross-section of an insert of the invention, according to a first embodiment.
Figure 2:
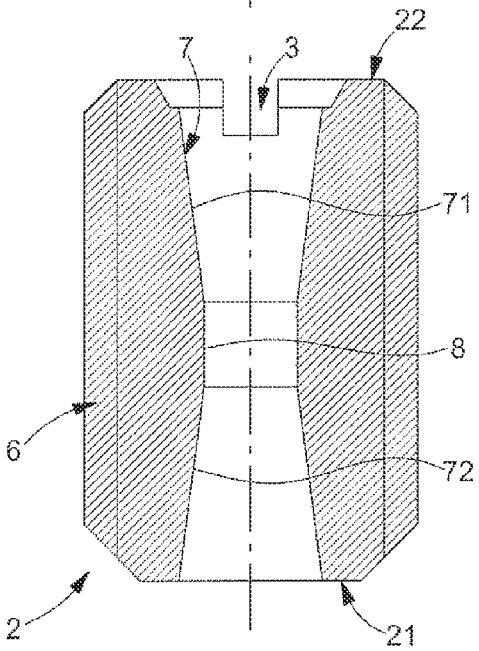
FIG. 2 shows another insert example according to the invention, in a similar manner to FIG. 1.
Figure 3:
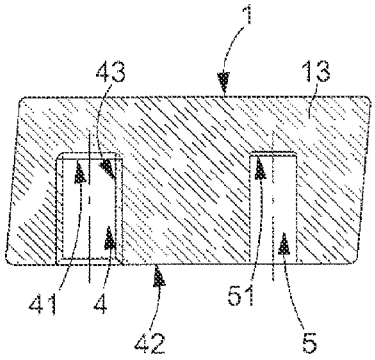
FIG. 3 shows a schematic longitudinal cross-section of a bare bracelet link suitable for implementing the invention.
Figure 7:
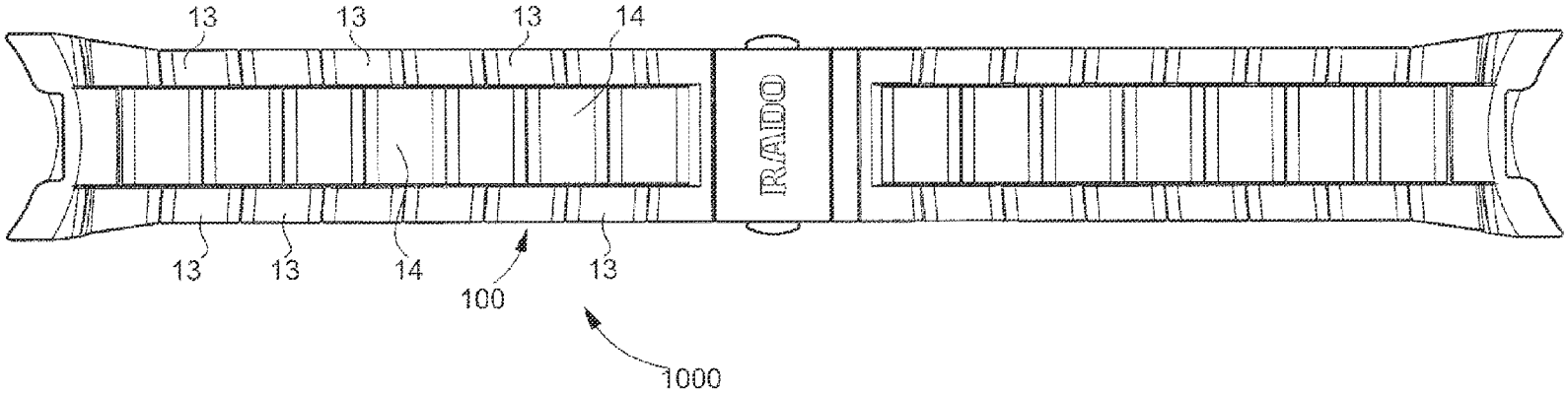
FIG. 7 shows a schematic plan view of a bracelet of this type.
Figure 8:
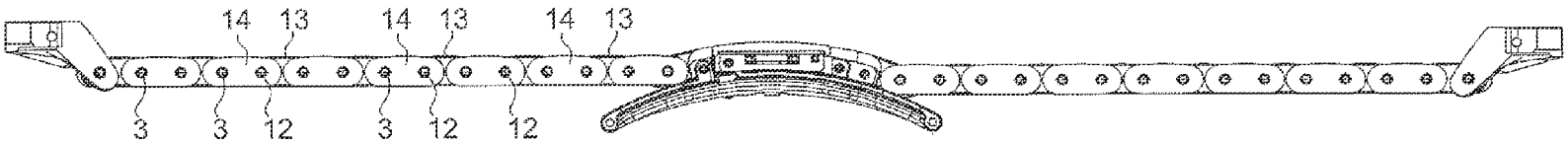
FIG. 8 shows the same bracelet in a schematic cross-section perpendicular to the direction of the spacer pieces.

The invention therefore concerns, as visible in FIG. 1 or 2, a housing insert 2 for a spacer piece 3 of a ceramic or similar link 1, of a bracelet 1000 or piece of jewellery or timepiece. This link 1 is of the type comprising at least a first, preferably non-cylindrical and preferably non-smooth housing 4 for receiving a spacer piece 3 or a pin having at least one end 9.

According to the invention, the insert 2 includes an external preferably non-cylindrical and preferably non-smooth machined portion 6 arranged to cooperate with some play with the first housing 4 and an internal machined portion 7 including at least one substantially cylindrical bearing area 8, arranged to closely receive a said end 9 of a said spacer piece 3 and having a smaller diameter than that of said end 9.

Preferably, this external machined portion 6 has a threaded profile or a non-cylindrical profile.

"External machined portion" 6 means here an external machined portion, which is preferably not smooth, i.e. arranged to favour adherence, and in particular adherence of adhesive, welding or brazing materials or any other filler materials. Indeed, in a variant, an irreversible assembly of insert 2 in first housing 4 of a link 1 is particularly envisaged, where this irreversible assembly can be achieved by welding, brazing, bonding or suchlike.

This irreversible assembly is a variant. Indeed, an alternative embodiment with an insert 2 provided with an external threaded machined portion 6, and a link 1 provided with an internal threaded machined portion for cooperating with said external thread, provides excellent results.

Thus, this external machined portion 6 may be achieved, in the simplest manner in the form of a helical thread, and it may equally well be formed by knurling, a series of grooves or rings, with reverse machined profiles, or other means, the important factor being that insert 2 is firmly assembled in a fragile ceramic link 1, without chipping or shattering said link. Therefore, preferably, the corresponding link 1 is also selected with a first housing 4 having a profile that facilitates adherence, and made in a similar manner. However, the respective profiles of first housing 4 and of external machined portion 6 must allow insert 2 to be inserted in first housing 4 without any stress.

The first housing 4 of link 1 includes, between a base 41 and a front face 42, a lateral machined portion 43. This machined portion 43 faces the external machined portion of insert 2.

Insert 2 has a back face 21 intended to face base 41 of first housing 4 and a front face 22 which is opposite thereto, and on which a tool engagement portion 23 is preferably arranged, for example a slot for a screwdriver or suchlike.

The possibility of adjusting the insertion of insert 2 in first housing 4 allows an embodiment to be selected where, in the first usual case, the back face 21 of insert 2 abuts on base 41 of the first housing, or, in a second case which is the reverse of the first, back face 21 of insert 2 is prevented from abutting on base 41 of the first housing, especially if the material of the links is particularly fragile, for example crystal or similar, and if, for example, automatic screwing means are used, then the insertion of insert 2 should prevent any impairment of link 1, which the invention is precisely intended to avoid. Advantageously, the length of insert 2, along the direction of insertion, is less than that of first housing 4.

In a variant that is not shown in the Figures, insert 2 is a stepped insert which has at least one shoulder, on the side opposite to that facing base 41. This shoulder can then cooperate, either with front face 42 of link 1 or, preferably, with a counterbore comprised in said link 1, set back from the front face 42, so as to make the assembly invisible, and to allow a precise joint between lateral links 13 and intermediate links 14 which together form a bracelet.

Preferably, insert 2 is used with a link 1 which includes, as first housing 4, an internal machined portion complementary to the external machined portion 6, particularly an internal thread for the preferred embodiment where external machined portion 6 is an external thread. However, insert 2 may equally well be combined with a housing 4 of any shape, under the conditions set out above.

Internal machined portion 7 is adapted to the type of spacer piece 3 intended to be assembled to link 1 and has a substantially complementary profile to that of an end 9 of said spacer piece 3, but dimensioned such that the assembly between said end 9 and said internal machining 7 is achieved with some gripping. This gripping is sufficiently slight to allow removal, and the cross-section of insert 2 between external machined portion 6 and internal machined portion 7 is sufficiently rigid for the deformation of the internal machined portion to have only a negligible effect on external machined portion 6.

Preferably, for cooperation with an end 9 which has a rotation profile, internal machined portion 7 includes at least one bearing area 8, which also has a rotation profile, preferably substantially cylindrical. This cylindrical bearing area may be preceded by an inlet profile 71, for example a cone, and followed by a housing 72, to ensure that the median part of insert 2 is held on this preferably cylindrical bearing area 8.

It is noted that the usual configuration of commercially available inserts, used in mechanics for the protection of threads subjected to frequent removal-assembly, such as for machining assemblies, covers, or suchlike, only exist in the form of external/internal threads. Threaded/pierced or threaded/reamed inserts, such as those envisaged in the implementation of the invention cannot be found.

The invention further concerns an equipped link 10, which includes at least one ceramic link 1, for a bracelet 1000, or piece of jewellery or timepiece. This link 1 includes at least a first preferably non cylindrical and preferably non-smooth housing 4 for receiving a spacer piece 3 or a pin. According to the invention, this equipped link includes at least one such insert 2 fixed in one such first housing 4.

In addition to first housing 4, occupied by insert 2, this equipped link 10 preferably includes at least a second housing 5, arranged for receiving another spacer piece or pin 12 with some play.

Preferably, first housing 4 has a threaded profile or a non-cylindrical profile.

Preferably, insert 2 is irreversibly fixed in first housing 4 of equipped link 10.

Preferably, the front face 22 of insert 2 is assembled set back from front face 42 of the first housing, so as not to damage any other bracelet links that may rest on this front face 42, and thus to guarantee a ceramic-ceramic contact between the links.

In a variant of the invention that is not shown in the Figures, the method of fabricating link 1 directly integrates insert 2, for example by moulding from a cast or over moulding. Preferably, the insert 2 integrated in link 1 is not yet pierced, at the manufacturing stage of link 1. Insert 2 is pierced during reworking, which guarantees a perfect geometry of bearing area 8 of internal machined portion 7 of insert 2, relative to link 1 and to the interfaces thereof with the other links forming the bracelet, for receiving an end 9 of a spacer piece 3. If an easily machinable material is selected for insert 2, such as a metal alloy or suchlike, the piercing-boring machining in a machined assembly guaranteeing the parallelisms and perpendicularities is inexpensive and does not raise any technical manufacturing problems. It is also possible to envisage fitting link 1 with other inserts, which will be pierced in the same operation as insert 2, to form the second housing 5. Naturally, if insert 2 is dimensioned on an ad hoc basis, the internal machined portion 7 of insert 2 and second housing 5 may also be realised in the same insert 2 integrated in link 1. In this variant, the equipped link 10 therefore includes one link 1 and at least one insert 2, which is integrated in the link during manufacture of said ceramic or similar link for a bracelet 1000 or piece of jewellery or timepiece, and this equipped link 10 includes at least one internal machined portion 7 having at least one substantially cylindrical bearing area 8, arranged to closely receive an end 9 of a spacer piece 3 and having a smaller diameter than that of said end 9.

A bracelet 1000 with invisible joints includes links 1 which are lateral links 13, surrounding intermediate median links 14 in a staggered arrangement. The lateral links 13 each include one insert 2 of this type, into which a first spacer piece 3 is driven and gripped. In pairs with said spacer piece 3, they form an indeformable H structure.

Each lateral link 13 further includes a second housing 5, which may or may not be provided with an insert, in which a pin 12 is assembled, preferably freely with some play.

The invention further concerns an assembled link 100 including, on both sides of a median plane P, at least two equipped links 10 and including at least one spacer piece 3. The spacer piece has two ends 9 and is arranged to cooperate, at the two ends, with two of the equipped links 10. This spacer piece 3 is driven and gripped, on both sides of median plane P, at each of the two ends 9 thereof, into an insert 2 comprised in each of the two equipped links 10 joined by said spacer piece 3.

Preferably, in addition to a first preferably non-cylindrical and preferably non-smooth housing 4 occupied by an insert 2, these two equipped links 10 each include at least a second housing 5 arranged to receive a pin 12 with some play, and two of the second housings 5 of the two equipped links 10 are aligned. Thus, these two second housings 5 of the two equipped links 10 may enclose a pin 12, pivotably mounted between them.

Preferably, the assembled link 100 forms an indeformable assembly, and the gripping of spacer pieces 3 in inserts 2 is sufficient resist to any torsion stress resulting from the movements of the user.

The invention further concerns a bracelet 1000. This term means any wristband or bracelet, in the proper sense of the term, or any piece of jewellery or timepiece or suchlike including a plurality of links 1 together forming a preferably articulated assembly. Naturally, the invention can also be applied to a totally or partially rigid bracelet. In such case, pins 12 are not assembled with any play in housings 15, but are tightened or gripped therein. In the case of rigid bracelets 1000, the lateral links are advantageously equipped links each including two first housings 4 and provided with inserts 2. The second housings 5 receiving pins 12 are thus of no use. Therefore, it remains entirely possible to dismantle a rigid bracelet 1000 made according to this embodiment.

According to the invention, this bracelet 1000 includes at least one such equipped link 10. This equipped link 10 is a lateral link 13 into which a removably mounted spacer piece 3 is driven. Indeed, simply driving spacer piece 3 into insert 2 in accordance with the invention also allows said spacer piece 3 to be driven out again, for example to adjust the size of bracelet 1000 or to alter said bracelet.

Preferably, bracelet 1000 includes at least one assembled link 100, and it includes at least one intermediate link 14, which is mounted to pivot freely, or relative to a spacer piece 3 driven and gripped into the equipped link 10 or into assembled link 100, or which is mounted to pivot freely with some play relative to a pin 12, which is pivotably mounted in the equipped link 10 or assembled link 100 concerned.

Preferably, this intermediate link 14 includes a first guide 15, which is arranged to directly or indirectly guide, with some play, the pivoting of a spacer piece 3, and a second guide 16, which is arranged to directly or indirectly guide, with some play, the pivoting of a pin 12. As seen in the Figures, these guides 15 and 16 can be made in the form of substantially cylindrical passages which may be protected by sleeves 17, in the form of tubes or slit tubes, as seen in FIG. 6, thus reducing the play between spacer piece 3 or pin 12 and intermediate link 14. FIG. 10 shows a variant of the invention including smooth tubes, referenced 18 in the intermediate links 14, and 19 in the lateral links 13, for limiting wear of the links.

In a preferred assembly, bracelet 1000 includes a plurality of these lateral links 13, assembled on both sides of median plane P, or symmetrical relative to said median plane P, and surrounding in pairs an intermediate link 14. This bracelet 1000 then has an alternately arranged series of fixed spacer pieces 3 and free pins 12.

Preferably, these spacer pieces 3 and pins 12 are assembled in parallel to each other.

Figure 9:
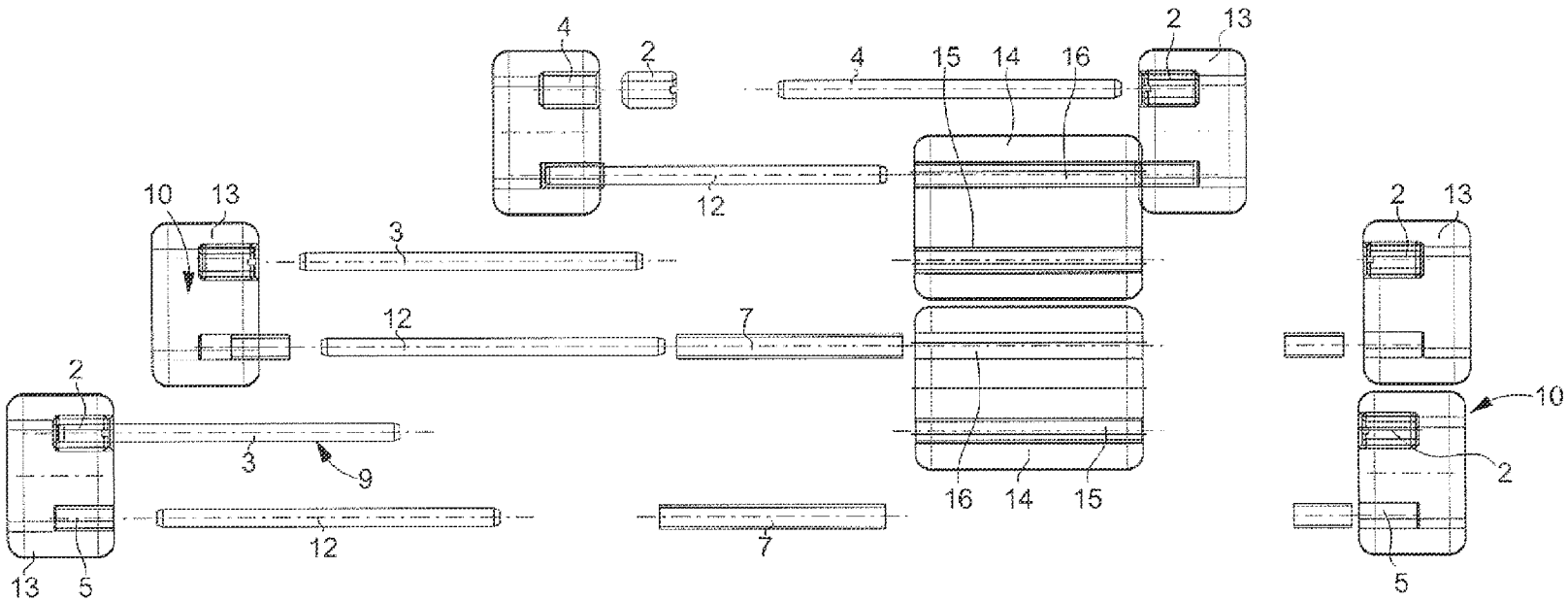
FIG. 9 shows a schematic view of an assembly sequence of this type of bracelet.

FIG. 9 illustrates the assembly sequence of a bracelet 1000 made with lateral links 13 including these inserts 2, incorporating sleeves 17 preferably in the form of anti-wear tubes, between spacer pieces 3 or pins 12, and intermediate median links 14.

Each median link 14, assembled in a staggered arrangement relative to lateral links 13 which face each other, includes two guides 15, and 16, particularly bores, which may or may not be covered by a tube to prevent wear, and which are used to guide the first pin and the second pin.

It is thus easy to assemble bracelet 1000, as seen in FIG. 9, in an assembly sequence in which, after each median link is inserted on a pin driven onto a first lateral link and said median link is trapped via a second lateral link opposite the first, the pin only needs to be driven onto the second lateral link.

This arrangement is invisible, very easy to achieve and does not weaken the ceramic material. It is also easy to dismantle, without damaging the ceramic links.

What is claimed is:

1. A housing insert for a spacer piece of a ceramic link for a bracelet or piece of jewellery or a timepiece, said link being of the type comprising at least a first housing for receiving a spacer piece or a pin having at least one end, wherein said insert includes an external machined portion arranged to cooperate with said first housing, and an internal machined portion including at least one substantially cylindrical bearing area arranged for closely receiving a said end of a said spacer piece and having a smaller diameter than that of said end, where said substantially cylindrical bearing is preceded by an inlet profile which is a cone, and followed by a housing, to ensure that the median part of said spacer is held on this substantially cylindrical bearing area.

2. An equipped link including at least one ceramic link for a bracelet or a piece of jewellery or a timepiece, said link including at least a first housing for receiving a spacer piece or a pin having at least one end, wherein said equipped link includes, fixed in said at least one first housing, at least a housing insert, wherein said housing insert includes an external machined portion arranged to cooperate with said first housing, and an internal machined portion including at least one substantially cylindrical bearing area arranged for closely receiving said end of a said spacer piece and having a smaller diameter than that of said end, where said substantially cylindrical bearing is preceded by an inlet profile which is a cone, and followed by a housing, to ensure that the median part of said spacer is held on said substantially cylindrical bearing area.

3. The equipped link according to claim 2, wherein said external machined portion includes a threaded profile or a non-cylindrical profile.

4. The equipped link according to claim 2, wherein said at least one insert is irreversibly fixed in said at least one first housing.

5. The equipped link according to claim 2, wherein at least one insert is fixed in said at least one first housing, and, in addition to said first housing occupied by said insert, said equipped link includes at least a second housing, arranged for receiving with play another spacer piece or a pin.

6. The equipped link according to claim 2, wherein said first housing includes a threaded profile or a non-cylindrical profile.

7. An assembled link including, on both sides of a median plane, at least two equipped links according to claim 2, and including at least one spacer piece having two ends arranged to cooperate, at said two ends, with two of said equipped links, wherein said spacer piece is driven, on both sides of said median plane, at each of the said ends thereof, into a said insert comprised in each of said two equipped links joined by said spacer piece.

8. A bracelet including a plurality of links, including at least one equipped link according to claim 2, wherein said equipped link is a lateral link into which a removably mounted spacer piece is driven and gripped.

9. The bracelet according to claim 8, including at least one assembled link including, on both sides of a median plane, at least two equipped links according to claim 2, and including at least one spacer piece having two ends arranged to cooperate, at said two ends, with two of said equipped links, wherein said spacer piece is driven, on both sides of said median plane, at each of the said ends thereof, into said insert comprised in each of said two equipped links joined by said spacer piece, and wherein it includes at least one intermediate link assembled to pivot freely relative to a spacer piece driven and gripped into said equipped link or said assembled link or relative to a pin pivotably mounted with play in said equipped link or in said assembled link.

10. The bracelet according to claim 8, wherein it includes at least one assembled link including, on both sides of a median plane, at least two equipped links according to claim 2, and including at least one spacer piece having two ends arranged to cooperate, at said two ends, with two of said equipped links, and wherein it includes at least one intermediate link assembled to pivot freely relative to a spacer piece driven and gripped into said equipped link or said assembled link or relative to a pin pivotably mounted with play in said equipped link or in said assembled link, and wherein a said intermediate link includes a first guide, arranged to directly or indirectly guide, with play, the pivoting of said spacer piece, and a second guide arranged to directly or indirectly guide, with play, the pivoting of one said pin, and wherein it includes a plurality of said lateral links mounted on both sides of said median plane and surrounding in pairs one said intermediate link, and wherein it includes an alternately assembled series of said spacer pieces and said pins.

11. An equipped link including a ceramic link, for a bracelet or a piece of jewellery or a timepiece, said link including at least a first housing for receiving a spacer piece or a pin having at least one end, wherein said equipped link includes at least one insert, which is integrated in said link during the manufacture of said link, and wherein said equipped link includes at least one internal machined portion including at least one substantially cylindrical bearing area, arranged to closely receive an end of a spacer piece and having a smaller diameter than that of said end.

12. An equipped link including a ceramic link, for a bracelet or a piece of jewellery or a timepiece, said link including at least a first housing for receiving a spacer piece or a pin having at least one end, wherein said equipped link includes at least one housing insert, wherein said housing insert includes an external machined portion arranged to cooperate with said first housing, and an internal machined portion including at least one substantially cylindrical bearing area arranged for closely receiving said end of said spacer piece and having a smaller diameter than that of said end, wherein said substantially cylindrical bearing is preceded by an inlet profile which is a cone, and followed by a housing, to ensure that the median part of said spacer is held on this substantially cylindrical bearing area, where said housing insert is integrated in said link during the manufacture of said link, and wherein said equipped link includes at least one internal machined portion including at least one substantially cylindrical bearing area, arranged to closely receive an end of a spacer piece and having a smaller diameter than that of said end.

13. The equipped link according to claim 12, wherein said insert includes an external machined portion arranged to cooperate with said first housing and an internal machined portion including at least one substantially cylindrical bearing area, arranged to closely receive said end of said spacer piece and having a smaller diameter than that of said end.

14. The equipped link according to claim 12, wherein said external machined portion includes a threaded profile or a non-cylindrical profile.

15. The equipped link according to claim 12, wherein said at least one insert is irreversibly fixed in said at least one first housing.

16. The equipped link according to claim 12, wherein at least one insert is fixed in said at least one first housing, and, in addition to said first housing occupied by said insert, said equipped link includes at least a second housing, arranged for receiving with play another spacer piece or a pin.

17. The equipped link according to claim 12, wherein said first housing includes a threaded profile or a non-cylindrical profile.

18. An assembled link including, on both sides of a median plane, at least two equipped links according to claim 12, and including at least one spacer piece having two ends arranged to cooperate, at said two ends, with two of said equipped links, wherein said spacer piece is driven, on both sides of said median plane, at each of the said ends thereof, into a said insert comprised in each of said two equipped links joined by said spacer piece.

19. The assembled link according to claim 7 or 18, wherein in each of said two equipped links at least one insert is irreversibly fixed in said at least one first housing, and, in addition to said first housing occupied by said insert, said equipped link includes at least a second housing, arranged for receiving with play another spacer piece or a pin, and wherein two of said second housings of said two equipped links are aligned, and wherein said two second housings of said two equipped links surround with play a pin which is pivotably mounted between said links.

20. A bracelet including a plurality of links, including at least one equipped link according to claim 12, wherein said equipped link is a lateral link into which a removably mounted spacer piece is driven and gripped.

21. The bracelet according to claim 20, including at least one assembled link including, on both sides of a median plane, at least two equipped links according to claim 12, and including at least one spacer piece having two ends arranged to cooperate, at said two ends, with two of said equipped links, wherein said spacer piece is driven, on both sides of said median plane, at each of the said ends thereof, into said insert comprised in each of said two equipped links joined by said spacer piece, and wherein it includes at least one intermediate link assembled to pivot freely relative to a spacer piece driven and gripped into said equipped link or said assembled link or relative to a pin pivotably mounted with play in said equipped link or in said assembled link.

22. The bracelet according to claim 20, wherein it includes at least one assembled link including, on both sides of a median plane, at least two equipped links according to claim 2, and including at least one spacer piece having two ends arranged to cooperate, at said two ends, with two of said equipped links, and wherein it includes at least one intermediate link assembled to pivot freely relative to a spacer piece driven and gripped into said equipped link or said assembled link or relative to a pin pivotably mounted with play in said equipped link or in said assembled link, and wherein a said intermediate link includes a first guide, arranged to directly or indirectly guide, with play, the pivoting of said spacer piece, and a second guide arranged to directly or indirectly guide, with play, the pivoting of one said pin, and wherein it includes a plurality of said lateral links mounted on both sides of said median plane and surrounding in pairs one said intermediate link, and wherein it includes an alternately assembled series of said spacer pieces and said pins.

23. The equipped link according to claim 12, wherein said insert includes an external machined portion arranged to cooperate with said first housing and an internal machined portion including at least one substantially cylindrical bearing area, arranged to closely receive said end of said spacer piece and having a smaller diameter than that of said end.

24. The equipped link according to claim 12, wherein said external machined portion includes a threaded profile or a non-cylindrical profile.

25. The equipped link according to claim 12, wherein said at least one insert is irreversibly fixed in said at least one first housing.

26. The equipped link according to claim 12, wherein at least one insert is fixed in said at least one first housing, and, in addition to said first housing occupied by said insert, said equipped link includes at least a second housing, arranged for receiving with play another spacer piece or a pin.

27. The equipped link according to claim 12, wherein said first housing includes a threaded profile or a non-cylindrical profile.

28. The assembled link including, on both sides of a median plane, at least two equipped links according to claim 12, and including at least one spacer piece having two ends arranged to cooperate, at said two ends, with two of said equipped links, wherein said spacer piece is driven, on both sides of said median plane, at each of said ends thereof, into said insert comprised in each of said two equipped links joined by said spacer piece.

29. The bracelet including a plurality of links, including at least one equipped link according to claim 13, wherein said equipped link is a lateral link into which a removably mounted spacer piece is driven and gripped.

30. The bracelet according to claim 29, including at least one assembled link including, on both sides of a median plane, at least two equipped links according to claim 12, and including at least one spacer piece having two ends arranged to cooperate, at said two ends, with two of said equipped links, wherein said spacer piece is driven, on both sides of said median plane, at each of the said ends thereof, into said insert comprised in each of said two equipped links joined by said spacer piece, and wherein it includes at least one intermediate link assembled to pivot freely relative to a spacer piece driven and gripped into said equipped link or said assembled link or relative to a pin pivotably mounted with play in said equipped link or in said assembled link.

31. The bracelet according to claim 29, wherein it includes at least one assembled link including, on both sides of a median plane, at least two equipped links according to claim 2, and including at least one spacer piece having two ends arranged to cooperate, at said two ends, with two of said equipped links, and wherein it includes at least one intermediate link assembled to pivot freely relative to a spacer piece driven and gripped into said equipped link or said assembled link or relative to a pin pivotably mounted with play in said equipped link or in said assembled link, and wherein a said intermediate link includes a first guide, arranged to directly or indirectly guide, with play, the pivoting of said spacer piece, and a second guide arranged to directly or indirectly guide, with play, the pivoting of one said pin, and wherein it includes a plurality of said lateral links mounted on both sides of said median plane and surrounding in pairs one said intermediate link, and wherein it includes an alternately assembled series of said spacer pieces and said pins.

* * * * *